US008011056B2

(12) United States Patent
Aldana

(10) Patent No.: US 8,011,056 B2
(45) Date of Patent: Sep. 6, 2011

(54) MOP AND MOP SHIELD

(76) Inventor: Salvador J. Aldana, Benicia, CA (US)

( * ) Notice: Subject to any disclaimer, the term of this patent is extended or adjusted under 35 U.S.C. 154(b) by 697 days.

(21) Appl. No.: 12/148,034

(22) Filed: Apr. 17, 2008

(65) Prior Publication Data

US 2009/0260174 A1 Oct. 22, 2009

(51) Int. Cl.
*A47L 13/20* (2006.01)

(52) U.S. Cl. ..... 15/120.1; 15/247; 15/116.1; 15/119.1; 15/229.2

(58) Field of Classification Search ..... 15/119.1, 15/120.1, 16.1, 229.2, 246, 247, 116.1
See application file for complete search history.

(56) References Cited

U.S. PATENT DOCUMENTS

| | | | | |
|---|---|---|---|---|
| 1,476,396 | A * | 12/1923 | Dickson | 15/247 |
| 3,364,512 | A * | 1/1968 | Yamashita et al. | 15/260 |
| 3,846,862 | A * | 11/1974 | Botting | 15/210.1 |
| 2002/0108197 | A1 * | 8/2002 | Specht | 15/120.1 |
| 2006/0016031 | A1 * | 1/2006 | Llanes | 15/119.1 |

* cited by examiner

*Primary Examiner* — Shay L Karls
(74) *Attorney, Agent, or Firm* — Paul R Martin

(57) ABSTRACT

A mop and mop shield or cover is described in which the mop shield is slideably mounted on the handle of a mop, and capable of being lowered over the head of the mop to protect it from damage. The protective shield can also be marked, so as to enable a person to identify the purpose for which the mop has been used.

10 Claims, 7 Drawing Sheets

MOP AND MOP SHIELD

BACKGROUND OF THE INVENTION (a) Field of the Invention

This invention relates to a protective device for use in connection with tools used for cleaning floors. More particularly, it relates to a shield or cover for wet mops that are commonly used for cleaning floors in commercial buildings, schools, and homes, and to the mop upon which the shield is mounted. The shield is mounted on the mop handle, and its position is adjustable up or down on the handle depending on whether or not the mop is in use.

In many commercial buildings, schools and the like that have hard surface floors such as concrete, stone, tile, vinyl or similar, the floors are conventionally cleaned with what is termed a wet mop. A wet mop comprises an elongated shaft or handle with a water absorbable mop head attached to the lower end of the handle. The water absorbable head generally comprises a plurality of cotton ropes of various dimensions tied together at the top, so as to form a single unit. The mop head can also be formed of water absorbable cloths, if desired.

In the mopping operation, water, which may or may not contain a detergent, is spread on the floor through various means, and the floor is swabbed with the mop. The mop head cleans the floor and absorbs the water which contains dissolved dirt and other contaminants. The dirty water is then wrung out of the mop head, and the process repeated until an entire floor is cleaned.

It is often desirable to use different mops for different sections of a building. That is, it is desirable to use one specific mop for bathrooms whose floors are frequently contaminated with urine, and another for less contaminated areas of a building such as hallways, etc. The mops are frequently carried from place to place, and so it is desirable to protect the clothes and skin of the person carrying the mop from coming into contact with, and being contaminated by the wet mop head. It is also desirable to be able to mark the mops in a manner that enables one to identify which mop is designed for specific areas.

This invention is concerned with a mop upon which is mounted a device for protection of a wet mop head, and for identification of mops designated for specific uses.

(b) Description of Related Art

U.S. Patent Publication No. 2006/0016031, Lianes, published Jan. 26, 2006, describes a cylinder attachment slideably mounted on a mop handle to wring water out of a mop. The cylinder has an array of apertures in its lower wider portion for release of the mop water when the dirty water-laden mop head is compressed inside it.

U.S. Pat. No. 3,846,862, Botting, issued Nov. 12, 1974, describes and claims a sheath for a curling broom designed to receive and to support the cornstalk brush of a curling broom to improve the effectiveness and life thereof. U.S. Pat. No. 1,476,396, Dickson, issued Dec. 4, 1923, describes and claims a sanitary broom mop. In this invention a broom is covered with a soft material that serves as a mop for wiping floors, walls, and the like.

U.S. Pat. No. 3,364,512, Yamashita, issued Jan. 23, 1968, describes and claims a mop squeezing cover which is slidable on the mop handle. When the squeezer is slid on the handle over the mop head, the squeezer wrings the water out of it, enabling the mop head to be reused. None of the above described patents disclose or make obvious the device of the present invention.

BRIEF SUMMARY OF THE INVENTION

The present invention is a mop upon which is mounted a protective mop shield or cover that is slideably mounted on the handle of the mop, and capable of being lowered over the head of the mop to protect it from damage, and to protect individuals who may be carrying the mop from coming into contact with a wet or contaminated mop head. The protective shield can also be marked, so as to enable a person to identify the purpose for which the mop is to be, or has been used.

DETAILED DESCRIPTION OF THE INVENTION

Figure 5:
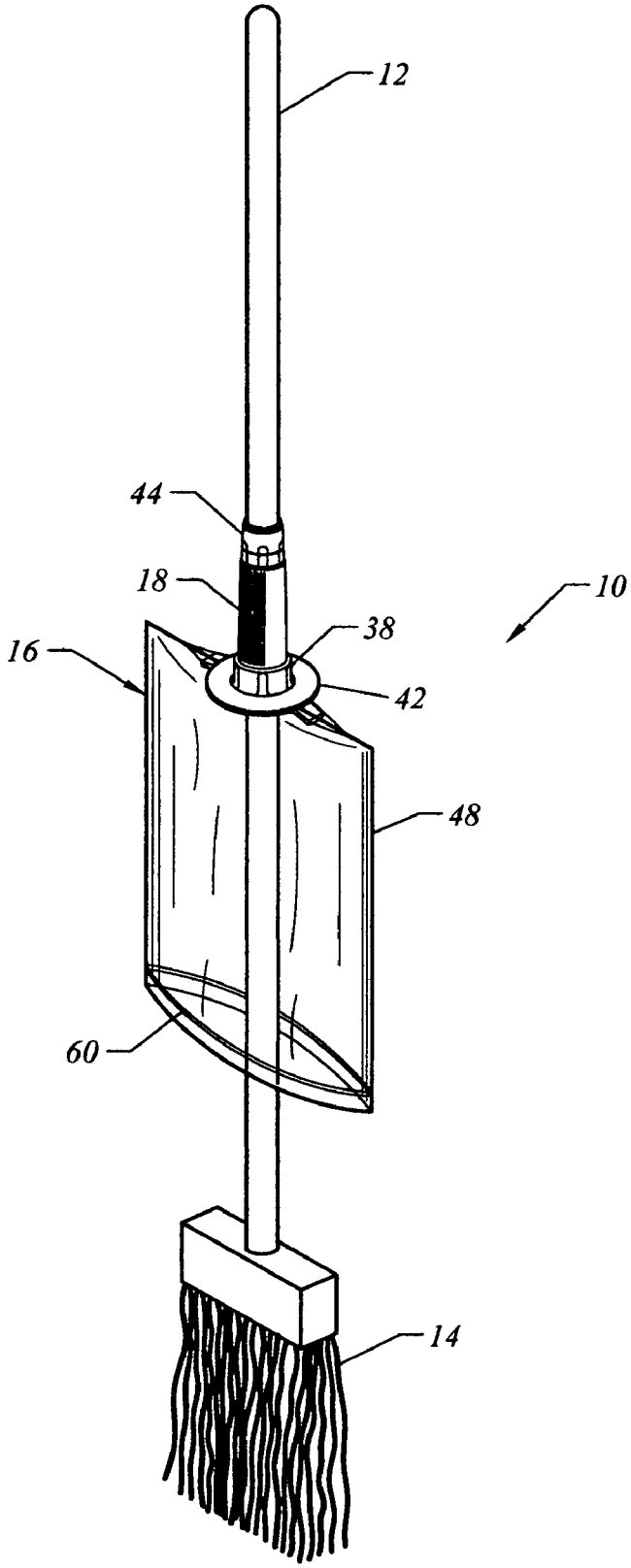
FIG. 5 is a perspective view of the mop of the invention showing the mop shield in a raised position relative to the head of the mop.
Figure 6:
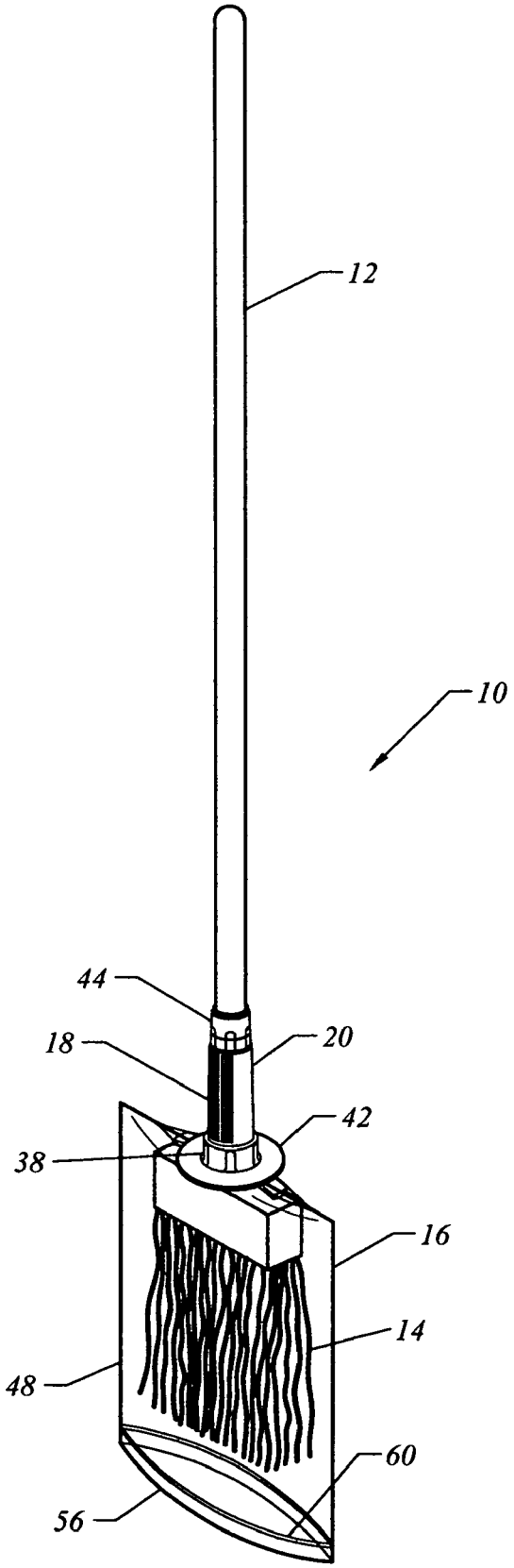
FIG. 6 is a perspective view of the mop of the invention showing the mop shield in a lowered position with the cover portion enclosing the mop head.

The mop and mop shield of the invention is best described with reference to the figures. As shown in FIGS. 5 and 6, the mop 10 of the invention comprises an elongated handle 12 with a mop head 14 attached at the lower end thereof. The handle 12 can be made of wood, plastic, metal, or any other suitable material. The head 14 is formed of a plurality of water absorbable ropes, preferably cotton, but it can be made of any water absorbable material. A mop shield 16 is attached to the handle of the mop 12 and is slideable relative thereto.

Figure 1:
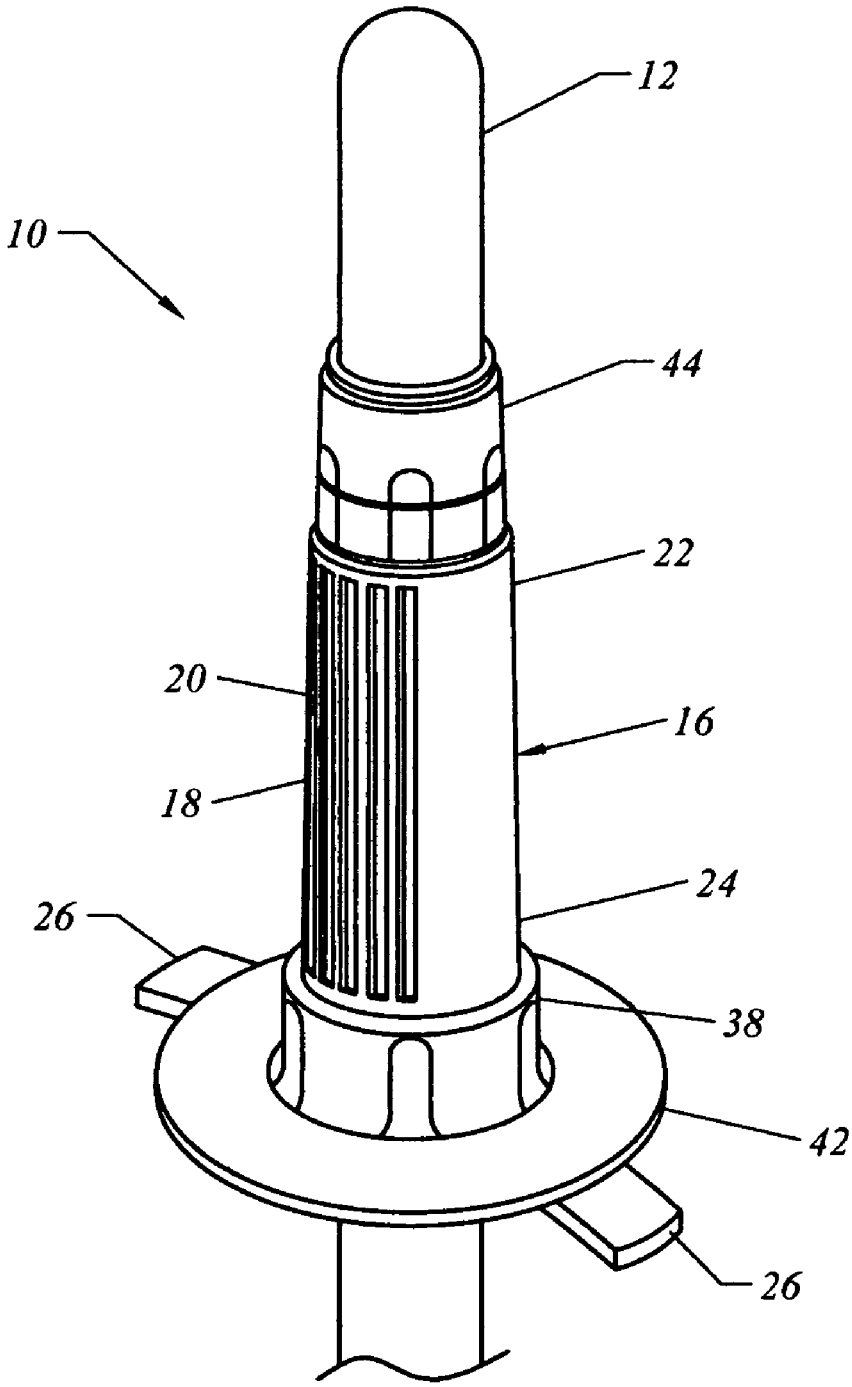
FIG. 1 is a perspective view of the slider mechanism of the mop shield of the invention.
Figure 2:
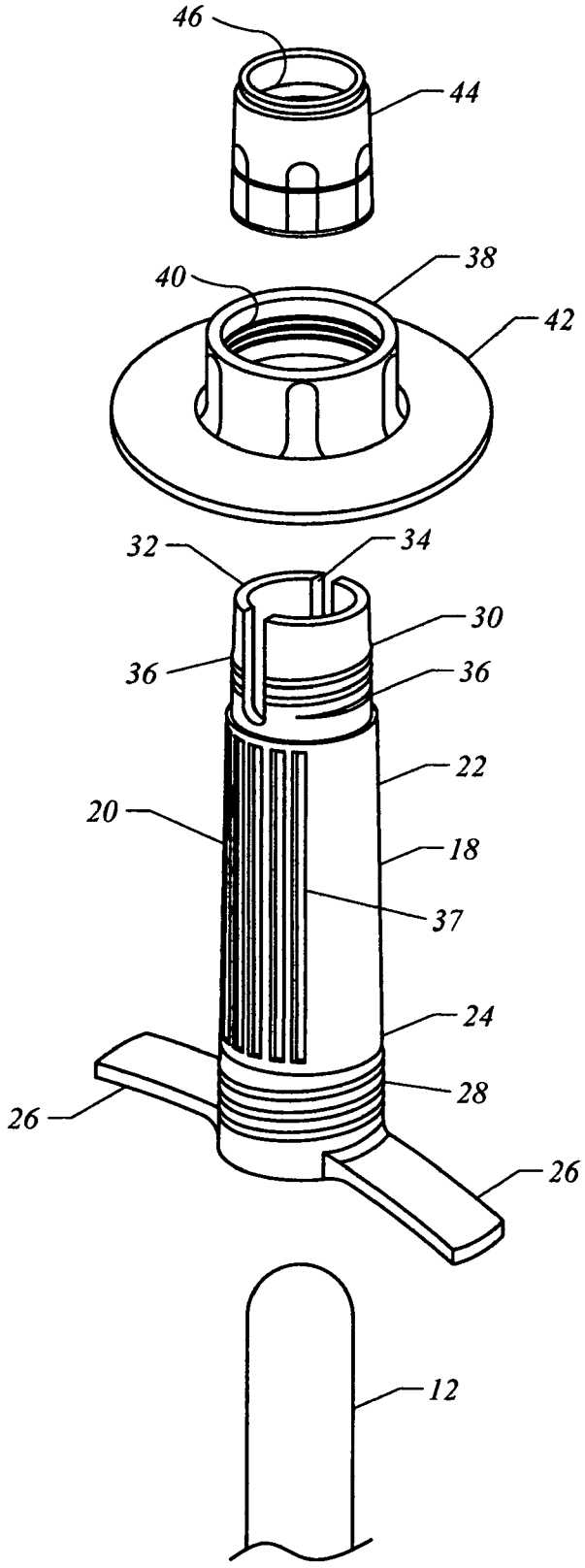
FIG. 2 is an exploded view of the slider mechanism for securing the mop shield to the handle of a mop.

The shield 16 can be separated into two distinct components. The first component, as shown best in FIG. 1, and the exploded view of FIG. 2, comprises a slider unit or mechanism 18 that is slideable up and down the mop handle 12. The slider mechanism 18 comprises an elongated tubular unit 20 whose internal diameter is slightly larger than the external diameter of the handle 12 of the mop 10 with which it is being used. In a preferred embodiment, the length of the tubular unit is 5¾ inches, its external diameter is 1 9/16 inches, and its internal diameter is 1⅜ inches. The tubular unit 20 has an upper end 22 and a lower end 24. A pair of wings 26, extend outwardly and substantially horizontally from the lower end 24 thereof. The tubular unit 20 has a threaded section 28 around its periphery above the wings 26. In a preferred embodiment, the wings are 1⅞ inches in length, and ¾ inches wide.

A pair of flexible arcuate fins 30 and 32 extend upward from the upper end 22 of the tubular unit 20. The arcuate fins 30 and 32 face each other, and are separated from each other by a slot 34. Each of the fins 30 and 32 has a threaded section 36 on the outside thereof that is contiguous with the threaded section of the opposite fin. Each of the arcuate fins 30, and 32 is about one inch high. The fins 30 and 32 have a certain degree of flexibility, enabling them to move inwardly in relation to pressure that may be applied on them. The entire tubular unit 20 is preferably made of a plastic material such as polyethylene or polycarbonate, but other suitable materials such as metal can be used also. The tubular unit 20 optionally has vertical ribs 37 on the outside thereof to give added strength, and a gripping surface for a user to grab onto when adjustment is to be made to the position of the slideable mechanism 18 on the mop handle 12.

A wing nut 38 having interior threads 40 (FIG. 2), and an outwardly extending horizontal flange 42 at the base thereof fits over the tubular unit 20. It is secured to the tubular unit 20 by threading its threads 40 over the threads 28 at the lower end 22 of the tubular unit 20. The threads 40 and the threaded section 28 are complementary to one another. The internal diameter of the wing nut 38 is slightly larger than the external diameter of the tubular unit 20. In a preferred embodiment, the wing nut 38 is 1⅝ inches tall, and the flange 42 extends about 1 inch horizontally. The external diameter of the wing nut is 1⅞ inches, while the internal diameter of the wing nut is 1 9/16 inches. It is preferably made of the same plastic material as the tubular unit 20.

A locking nut 44 with internal threads 46 fits over the fins 30 and 32, and is fastened to the tubular unit 20 by threading it over the threads 36 on the fins 30 and 32. In a preferred embodiment, the locking nut is about 1 7/16 inches high. The internal diameter of the locking nut 44 is greater at the bottom than at the top. In a preferred embodiment, it has an internal diameter at its bottom of 1⅜ inches, and an internal diameter at its top of about 1 inch. Thus when the internal threads 46 of the locking nut 44 engage the threads 36 on the flexible fins 30 and 32, continued screw action and the reduced diameter of the locking nut 44 at the top thereof, forces the fins 30 and 32 inward to engage the mop handle 12, thus securing the slider mechanism 18 in a fixed position on the handle 12 of the mop 10. When it is desired to move the slider mechanism 18, the locking nut 44 is released, or loosened, and the slider mechanism 18 repositioned to another desired position on the handle 12.

The slider mechanism 18 portion of this invention can be made of any suitable material, but is preferably made of plastic. Polyethylene is the preferred plastic material. Other material, such as aluminum can be used, but plastic is cheaper, and more easily molded, and so is the preferred material.

Figure 3:
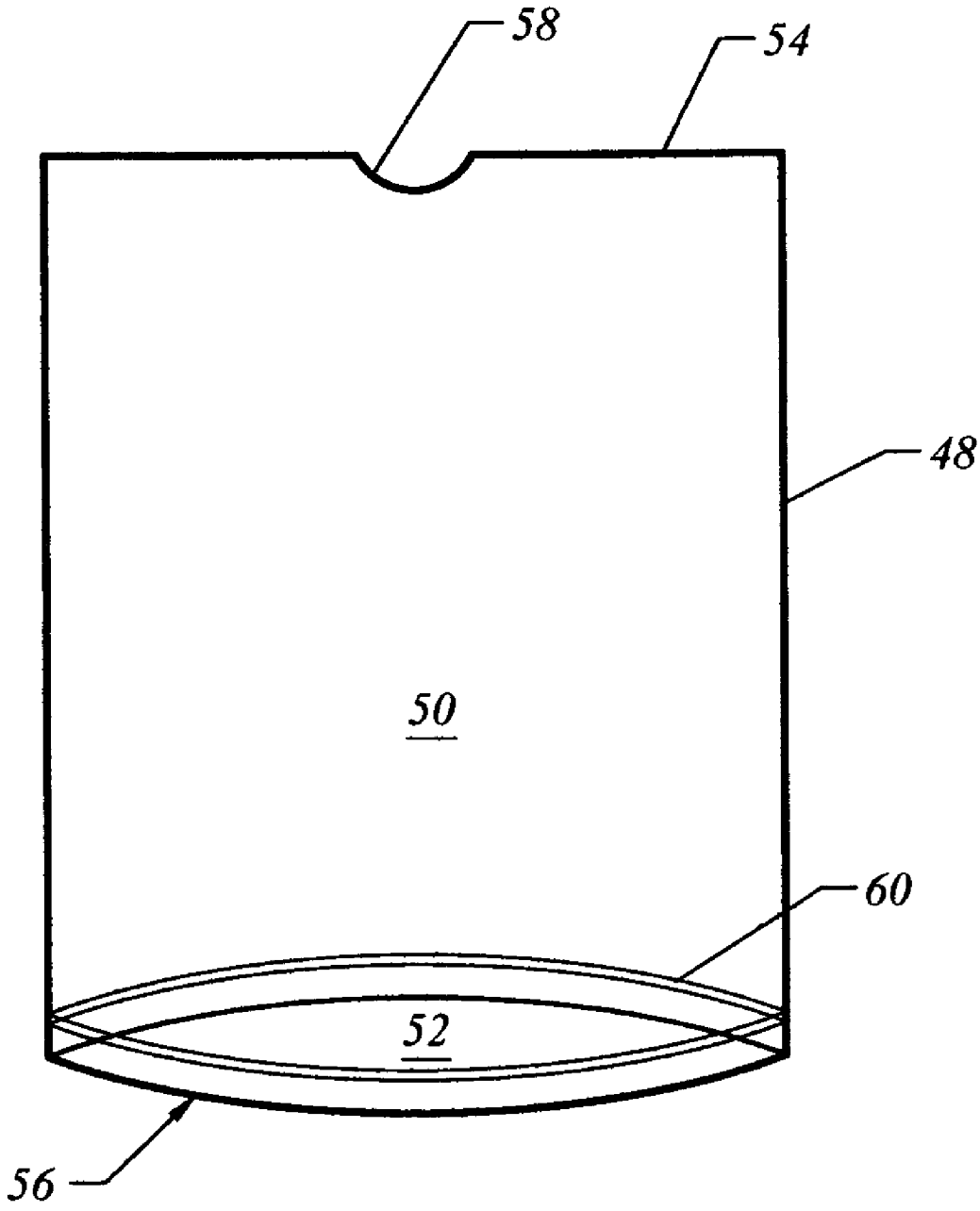
FIG. 3 is a side view of the shield or cover portion of the mop shield of the invention.
Figure 4:
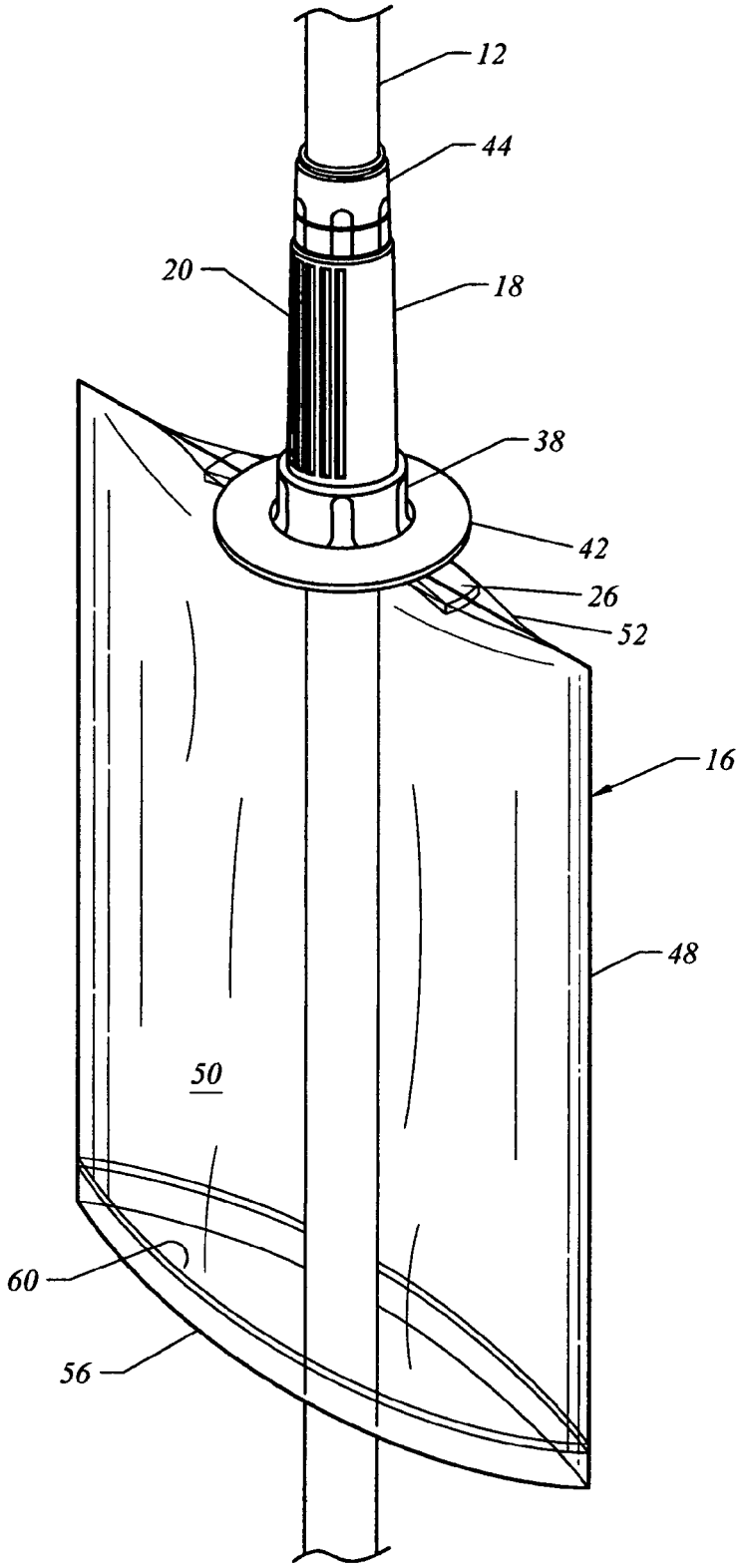
FIG. 4 is an view of the slider mechanism of FIG. 2 to which is attached a shield or cover for the head of a mop.

The second component of the mop shield 16 of the invention is a cover 48 which is secured to the slider mechanism 18, as seen in FIG. 4. As seen in FIGS. 3 and 4, the cover 48 is rectangular in shape, and is formed like an envelope, having front 50 and back sides 52, a closed top 54, and an open bottom 56. The cover 48 has an opening 58 in the top through which the shaft of a mop handle 12 can be inserted. The opening 58 has to be sufficiently large so as to enable it to pass over the tubular unit 20 without damage. The cover 48 optionally has a zip lock configuration 60 adjacent the open bottom 56, so as to enable the bottom 56 to be closed, thus insuring complete enclosure of the mop head 14 if desired.

In a preferred embodiment, the cover 48 is 18 inches tall, 13 inches wide, and is made of 6 mil thick, clear plastic sheeting. If desired, the specific room or area for which the mop is to be used can be marked on the plastic sheeting with a suitable marking device.

The cover 48 is mounted on the slider mechanism 18 by first positioning the tubular unit 20 on the handle 12 of the mop 10, at a desired location, then inserting the handle 12 through the open bottom 56 of the cover, then the opening 58 at the top of the cover 48, and bringing the cover 48 down so that the inside surface of the cover 48 at the top thereof, rests on the horizontal wings 26 of the tubular unit 20. See FIG. 4. Next, the wing nut 38 is screwed down on the threads 28 of the tubular unit 20, simultaneously pressing down on the top external surface of the cover 48, and fixing the cover 48 in position. That is, as seen in FIG. 4, the cover 48 is fastened in position between the flanges 42 of the wing nut 38 and the wings 26 of the tubular unit 20. Following this, the locking nut 44 is put into place by screwing it onto the threads 36 of the fins 30 and 32.

Figure 7:
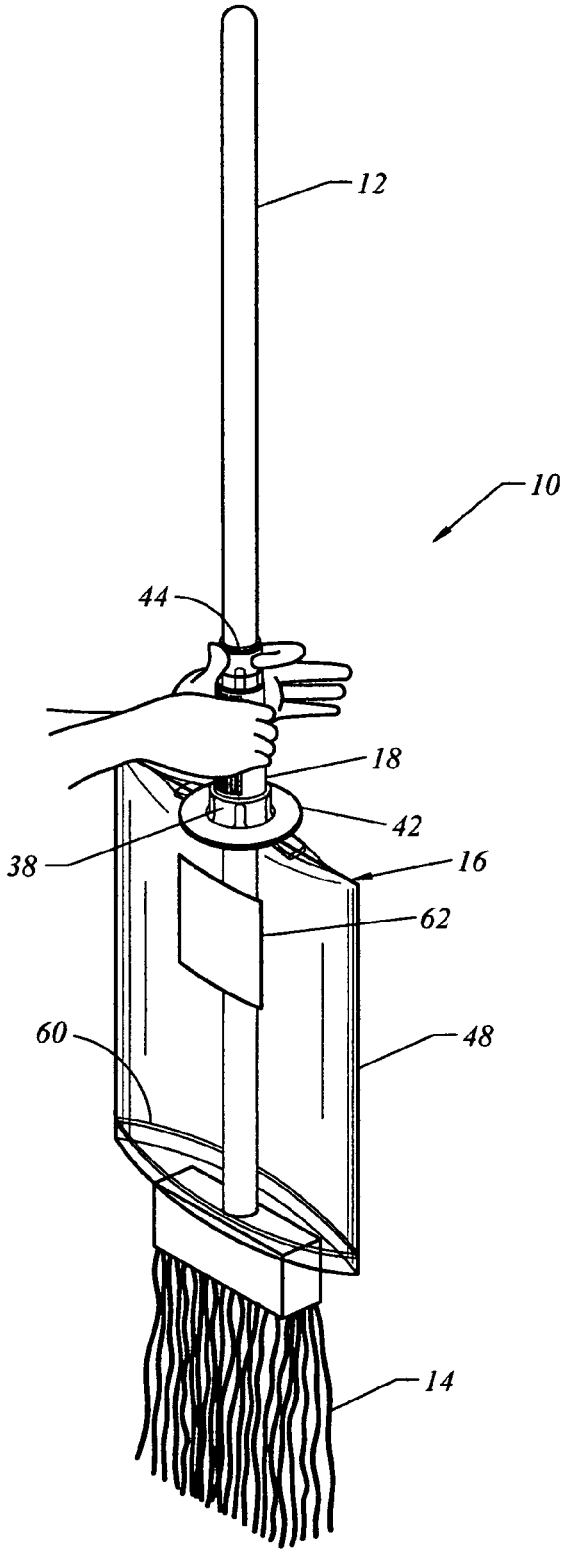
FIG. 7 is a perspective view of the mop shield of the invention showing its position on a mop handle being adjusted by the user.

The position of the slider mechanism 18 on the mop handle 12 can be adjusted by loosening the locking nut 44, moving the slider mechanism 18 to the desired position, then tightening the locking nut 44 again. See FIG. 7. As previously stated, tightening the locking nut 44 forces the fins 30 and 32 inward to press on the handle 12, thus fixing the mop shield 16 in place.

FIG. 5 shows the position of the mop shield 16 of this invention in a raised position, and FIG. 6 shows it in the lowered position with the cover 48 surrounding the mop head 14. The position of the mop shield 16 of the invention can be adjusted on the mop handle 12 as desired. Thus, as previously stated, the invention is a mop upon which is mounted the mop shield described herein.

It will be understood by those skilled in the art that various modifications can be made in the mop and mop shield of the invention without departing from the spirit and scope of the invention.

The invention claimed is:

1. A mop with a mop shield attached thereto which comprises (a) a mop comprising an elongated rod like handle with upper and lower ends, and a mop head attached to the lower end of said handle, (b) a slider mechanism positioned on and surrounding the handle of said mop, the position of said slider mechanism on said handle being adjustable relative thereto, said slider mechanism comprising an elongated tubular unit having upper and lower ends and a circumferential outer surface, said tubular unit having wings extending horizontally outward from the lower end thereof, threads cut into the outer surface of said tubular unit at the lower end thereof above said wings, a pair of opposed flexible arcuate fins projecting upwardly from the upper end of said tubular unit, said arcuate fins having circumferential outer surfaces, said fins having co-extensive threads cut into the outer surfaces thereof, a tubular wing nut having upper and lower ends, internal threads, and an outwardly extending horizontal flange at the lower end thereof, said wing nut being threaded onto the threads situated on the lower end of the tubular unit thereby bringing said flange into close relationship with said wings, and a tubular locking nut having internal threads, said locking nut being threaded onto the threads cut into the outer surfaces of said fins at the upper end of said tubular unit, wherein the various components of the slider mechanism when assembled together define a tube through which the handle of said mop extends, and (c) a cover fixed to said mechanism that is of a size sufficient to fit over, enclose and protect the head of the mop.

2. The mop of claim 1 wherein said cover comprises a rectangular shaped envelope having front and back sides, a closed top with a hole in the center thereof, and open bottom, and is fixed to said slider mechanism by inserting the handle of the mop through the opening in the center thereof, and positioning the closed top of it between the wing of the elongated tubular unit, and said horizontal flange of the wing nut.

3. The mop of claim 2 wherein said cover is made of 6 mil transparent plastic.

4. The mop of claim 1 wherein when said locking nut is threaded onto the threads of said fins, it urges said fins against the handle of the mop, thereby fixing the slider mechanism in place.

5. The mop of claim 1 wherein said mop head comprises a water absorbable material.

6. The mop of claim 5 wherein said water absorbable material is a plurality of cotton ropes.

7. A shield for a mop, wherein the mop comprises an elongated round rod like handle having upper and lower ends, and a fluid absorbable mop head attached to the lower end of said handle, said shield comprising, (a) a slider mechanism positioned on and surrounding the handle of said mop, the position of said slider mechanism on said handle being adjustable relative thereto, said slider mechanism comprising an elongated tubular unit having upper and lower ends and a circumferential outer surface, said tubular unit having wings extending horizontally outward from the lower end thereof, threads cut into the outer surface of said tubular unit at the lower end thereof above said wings, a pair of opposed flexible arcuate fins projecting upwardly from the upper end of said tubular unit, said arcuate fins having circumferential outer surfaces, said fins having co-extensive threads cut into the outer surfaces thereof, a tubular wing nut having upper and lower ends, internal threads, and an outwardly extending horizontal flange at the lower end thereof, said wing nut being threaded onto the threads situated on the lower end of the tubular unit thereby bringing said flange into close relationship with said wings, and a tubular locking nut having internal threads, said locking nut being threaded onto the threads cut into the outer surfaces of said fins at the upper end of said tubular unit, wherein the various components of the slider mechanism when assembled together define a tube through which the handle of said mop extends, and (b) a cover fixed to said slider mechanism that is of a size sufficient to fit over, enclose and protect the head of the mop.

8. The shield of claim 7 wherein said cover comprises a rectangular shaped envelope having front and back sides, a closed top with an opening in the center thereof, and open bottom, and is fixed to said slider mechanism by inserting the handle of the mop through the opening in the center thereof, and positioning the closed top of it between the wings of the elongated tubular unit, and the horizontal flange of the wing nut.

9. The shield of claim 8 wherein said cover is made of 6 mil transparent plastic.

10. The shield of claim 7 wherein when said locking nut is threaded onto the threads of said fins, it urges said fins against the handle of the mop, thereby fixing the slider mechanism in place.

* * * * *